US007963087B2

(12) United States Patent
Länsikallio

(10) Patent No.: US 7,963,087 B2
(45) Date of Patent: Jun. 21, 2011

(54) WRAPPING DEVICE AND METHOD FOR OPERATING A WRAPPING DEVICE

(75) Inventor: Juha-Matti Länsikallio, Mantila (FI)

(73) Assignee: KNA Corporation Oy, Jalasjarvi (FI)

( * ) Notice: Subject to any disclaimer, the term of this patent is extended or adjusted under 35 U.S.C. 154(b) by 217 days.

(21) Appl. No.: 12/226,333

(22) PCT Filed: May 10, 2007

(86) PCT No.: PCT/FI2007/050267

§ 371 (c)(1),
(2), (4) Date: Oct. 14, 2008

(87) PCT Pub. No.: WO2007/128885

PCT Pub. Date: Nov. 15, 2007

(65) Prior Publication Data

US 2009/0158692 A1 Jun. 25, 2009

(30) Foreign Application Priority Data

May 10, 2006 (FI) ..... 20060457

(51) Int. Cl.
*B65B 11/00* (2006.01)
*B65B 13/04* (2006.01)

(52) U.S. Cl. ..... 53/409; 53/587; 53/204; 53/399; 53/556

(58) Field of Classification Search ..... 53/587, 53/588, 589, 204, 581, 409, 399, 556
See application file for complete search history.

(56) References Cited

U.S. PATENT DOCUMENTS

| | | | | |
|---|---|---|---|---|
| 4,829,753 | A | 5/1989 | Bricmont | |
| 5,282,347 | A * | 2/1994 | Cleine et al. | 53/204 |
| 6,305,145 | B2 * | 10/2001 | Suolahti | 53/64 |
| 6,520,445 | B2 * | 2/2003 | Araujo | 242/434.5 |

FOREIGN PATENT DOCUMENTS

| | | |
|---|---|---|
| DE | 20012889 | 1/2001 |
| EP | 1464579 | 10/2004 |
| WO | 9521769 | 8/1995 |
| WO | 9636535 | 11/1996 |
| WO | 0170575 | 9/2001 |

* cited by examiner

*Primary Examiner* — Hemant M Desai
(74) *Attorney, Agent, or Firm* — Fildes & Outland, P.C.

(57) ABSTRACT

The invention relates to a wrapping device, which includes a frame, a wrapping ring arranged to move relative to the frame, which in the wrapping position is arranged to travel through the center hole of the piece being wrapped, and which, in the vertical direction, can be at least partly moved away from the wrapping position, in order to change the piece being wrapped, and a wrapping head arranged to rotate around the wrapping ring, in order to wrap the wrapping material around the piece. The wrapping ring can be moved away from inside the center hole of the piece being wrapped, in order to move the wrapping ring in its entirety away from the said wrapping position. In addition, the invention also relates to a method for operating the wrapping device.

14 Claims, 5 Drawing Sheets

WRAPPING DEVICE AND METHOD FOR OPERATING A WRAPPING DEVICE

Figure 1:
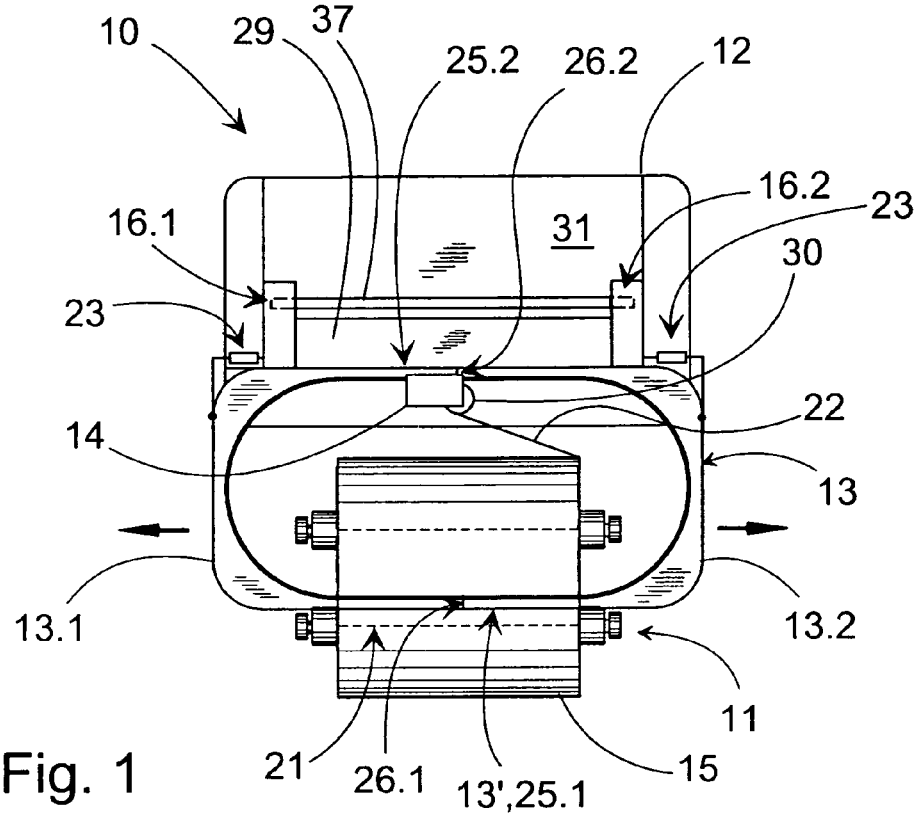

The present application is a National Stage Application of PCT Application No. PCT/FI2007/050267 filed May 10, 2007, which in turn, claims priority of Finland Patent Application No. 20060457, filed May 10, 2006.

The present invention relates to a wrapping device, which includes a frame, a wrapping ring arranged to move relative to the frame, and which, in the wrapping position, is arranged to travel through the centre hole of the piece being wrapped, and which, in the vertical direction, can be at least partly moved away from the wrapping position, in order to change the piece being wrapped, and a wrapping head arranged to rotate around the wrapping ring, in order to wrap the wrapping material around the piece.

In addition, the invention also relates to a method for operating a wrapping device.

There are several known solutions for wrapping cylindrical pieces with a centre hole. Such are disclosed in, among others, the patent documents DE-1192094, U.S. Pat. No. 4,829,753, WO-01/42085 A1, WO-95/21796, EP-1 253 083 A1, AU-9224506, WO-03/09311 A1, EP-0 936 142 A2, EP-0 544 312, U.S. Pat. No. 6,688,076 B1, and EP-1 464 579 A2.

Patent document DE-1192094 discloses a wrapping device, in which the wrapping ring, which is in a vertical position, moves in the axial direction of the piece being wrapped, in order to feed and remove the pieces being wrapped to and from the wrapping, by utilizing, for example, a portal crane. The problem with this construction is that a construction of the type described cannot be utilized in wrapping lines, in which a conveyor apparatus, for example is used to feed and remove the pieces being wrapped.

U.S. Pat. No. 4,829,753 discloses a wrapping-device solution, in which the wrapping ring is on the horizontal plane and opens in a scissors manner. This construction permits the pieces being wrapped to be fed directly to the wrapping, for example, utilizing a portal crane. However, the ring structure, which opens in a scissors-like manner, does not permit even the slightest movement of the piece being wrapped in the direction of its axis during wrapping. If the piece being wrapped moves during wrapping, the wrapping ring can no longer be opened, due to the limited size of the centre hole of the piece being wrapped. In addition, the construction described does not permit the pieces being wrapped to be fed to the wrapping on a conveyor apparatus in the direction of its axis. The parts of the wrapping ring that opens in a scissors-like manner limit the free space available for the feed of the pieces being wrapped. Thus there is a great risk that during feeding or removal the piece being wrapped will collide with the wrapping ring and damage it.

FIG. 16 of patent application EP-1 464 579 A2 shows a wrapping device, in which there is a wrapping ring that is in two parts, turning vertically around a pivot point and movably attached to a vertical pillar. In the construction described, one of the parts of the ring turns in such a way that an acute angle is formed between the planes formed by the parts. The other part of the ring remains inside the centre hole of the piece being wrapped, or at least in its wrapping position, so that the piece can be removed from the rotation space by moving it in the axial direction. Implemented as described, it is difficult to achieve sufficient stiffness in the wrapping ring and its attachment, due to the large span of the wrapping ring when it is opened. The partial turning of the wrapping ring does not sufficiently eliminate the risk of damaging the wrapping ring when bringing the pieces being wrapped to the wrapping device and removing them from it.

In patent documents WO-01/42085 and EP-0 936 142 A2, a vertically positioned wrapping ring is fitted in a portal-type frame. In the solution according to EP-0 544 312, the ring is supported from one side on a frame located at the end of the device. A wrapping ring set in a vertical position in the ways described makes the wrapping device high. This leads to several drawbacks in the frame and ring-structure solutions and, in addition, in the operation and maintenance of the device.

A construction with a portal-type frame becomes unavoidably high, so that its structure has considerable stiffness requirements. It is difficult to achieve sufficient stiffness in an open portal structure, without angled supports. An additional difficulty of such a structure is that most of mass of the device and the frame must be placed in the upper part of the frame. Both the feeding of the pieces being wrapped into the wrapping device and their removal from it, as well as the replacement of the wrapping material, demand, on the other hand a structure that is open from one or both sides, with no angled supports. A wrapping ring that is supported from only one side requires sufficient stiffness of the wrapping ring for being able to operate. A wrapping ring with a known construction must be extremely stiff, due the frame structure being located at the end of the device and the great span arising from this. This leads in turn to a large mass that must be moved. In the solutions referred to, the operation of the device requires the operating devices and elements that make operation possible to be generally in the upper part of the device, to which there is easy access is required for maintenance operations.

One drawback of the aforementioned wrapping-device solutions is that their construction, which is closed from above, does not permit the pieces being wrapped to be brought directly for wrapping, for example, utilizing a roof crane in the packaging area of the factory. Wrapping devices like those described always require a transfer apparatus, by means of which either the piece being wrapped is transferred to the wrapping device, or the wrapping device is moved over the piece being wrapped. In addition, the automatic changing of the wrapping-material reel requires the wrapping ring to be opened and moved, either upwards or to the side. After this, the wrapping ring must be closed and the wrapping head run to the changing position. In addition, the continuation of wrapping requires the operations described to be repeated, in such a way that the wrapping ring becomes once again closed through the centre hole of the piece being wrapped. The performance of these operations demands a great deal of time, so that the wrapping device does not operate efficiently.

The present invention is intended to create a wrapping device with a simple construction, and in connection with which the pieces being wrapped can be handled easily and without difficulty. The characteristic features of the wrapping device according to the invention are stated in the accompanying claims. In addition, the invention also relates to an apparatus for changing the wrapping material and methods for operating the wrapping device and for changing the wrapping-material cartridge.

In the wrapping device according to the invention, the wrapping ring can be moved out of the centre hole of the piece being wrapping, in order to turn the totality away from the wrapping position.

The construction of the wrapping device according to the invention is low and open from both above and from the sides. The pieces being wrapped can be fed and removed, or stated more generally, changed, without the risk of damaging the wrapping ring, because the space reserved for wrapping is free of the wrapping ring and the surroundings of the space are free of obstacles when examined from every potential direction for feeding the piece. The frame structure of the device is sturdy, low, and simple. The structure of the wrapping ring is light. The service points on the device are easily accessed, without separate or attached service platforms and stairs.

Pieces being wrapped can be feed to and removed from the device in several different ways. The construction, which is open from above, permits pieces being wrapped to be fed and removed from directly above. Pieces can also be brought and removed from the front, or also from the sides of the wrapping device. The same basic construction can be used in different application solutions.

In the wrapping device according to the invention, the changing of the wrapping-material reel can even be implemented in such a way that the wrapping ring need not be opened and moved away from the wrapping position in connection with changing.

Figure 2:
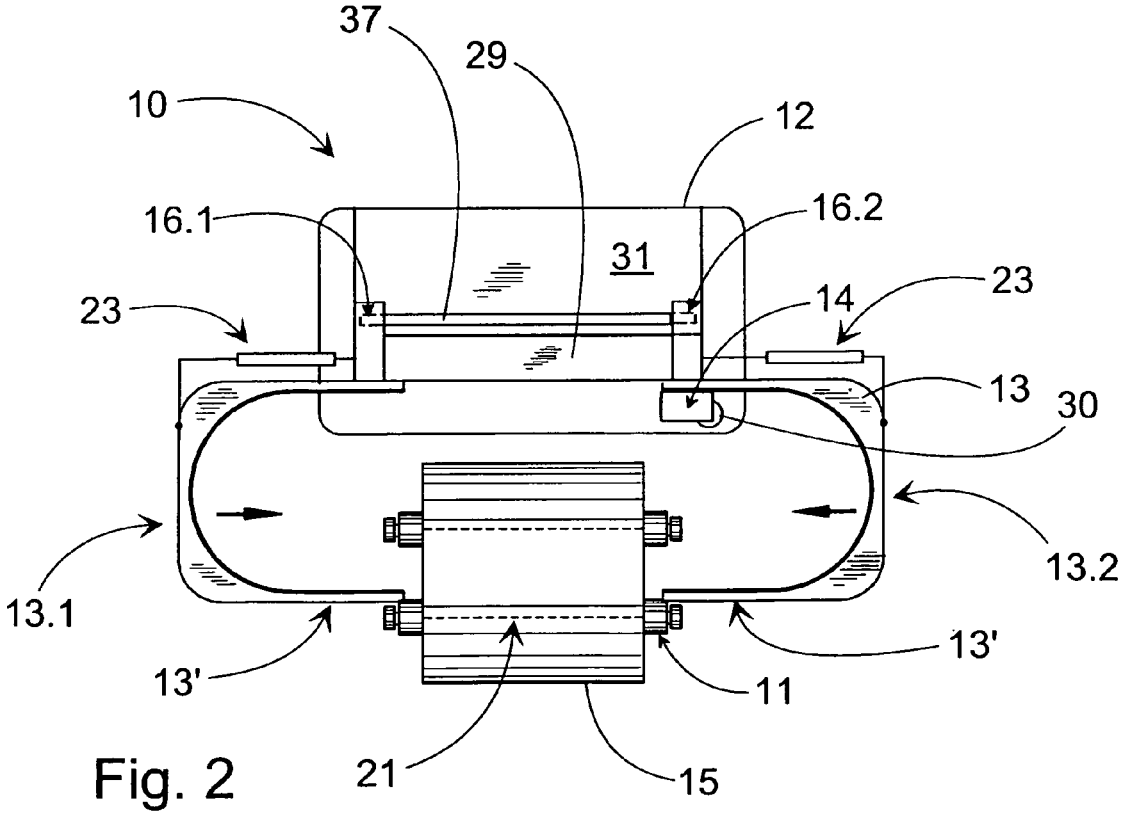
Figure 3:
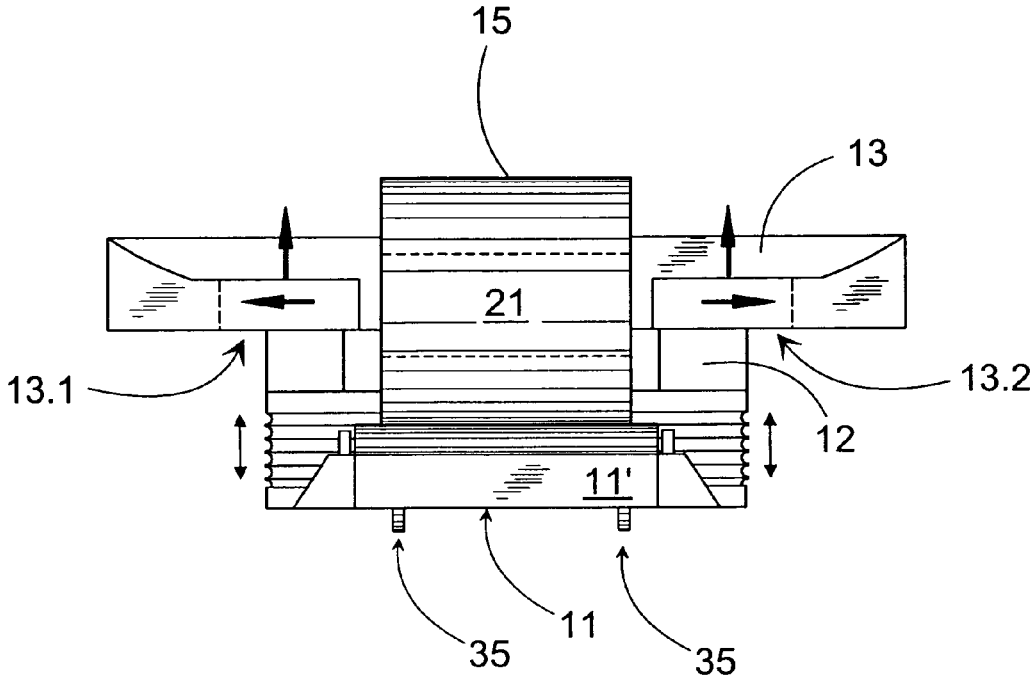
Figure 4:
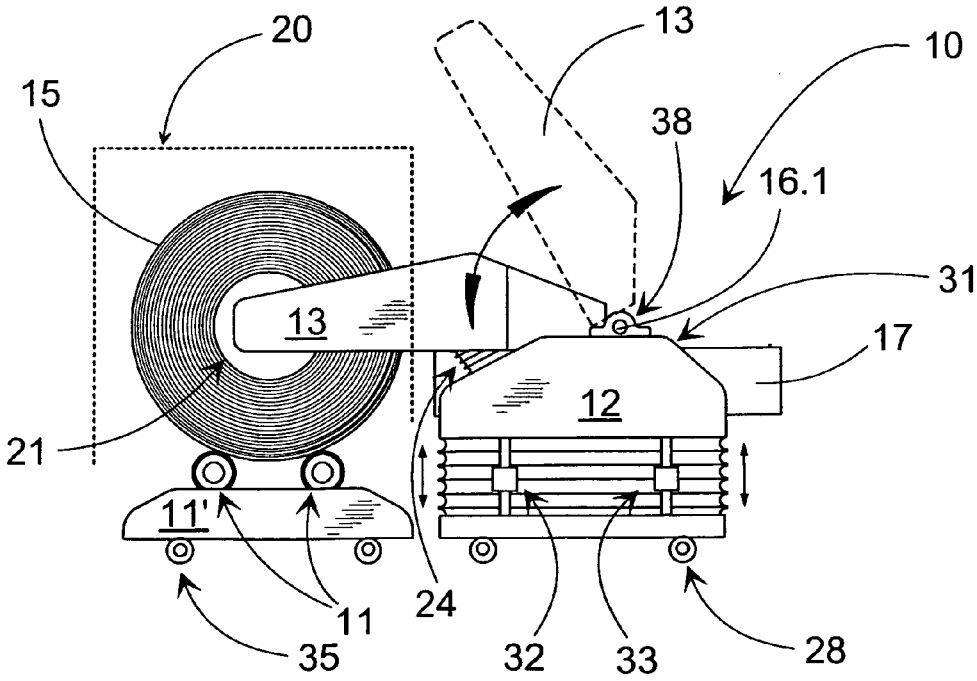
Figure 5:
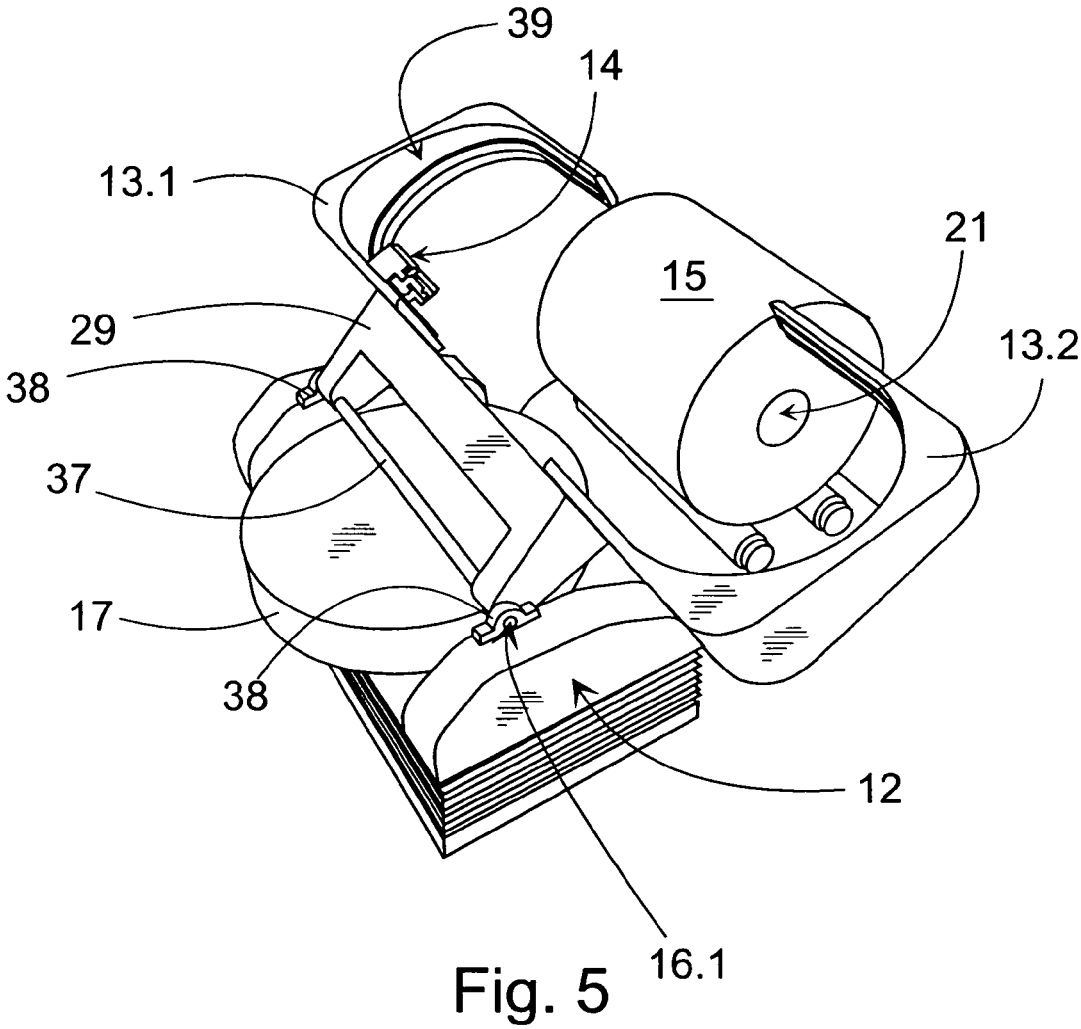
Figure 6:
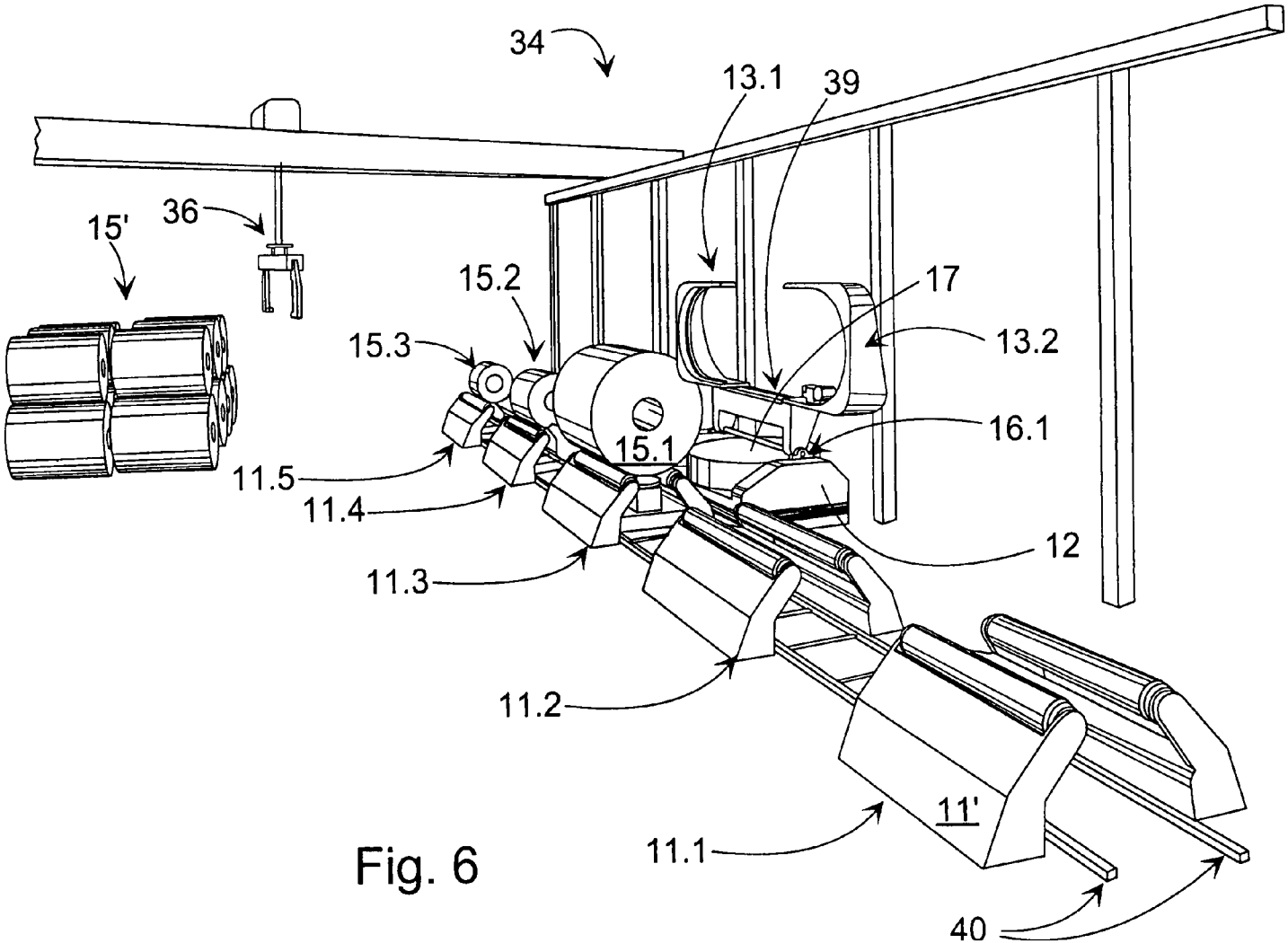
Figure 7:
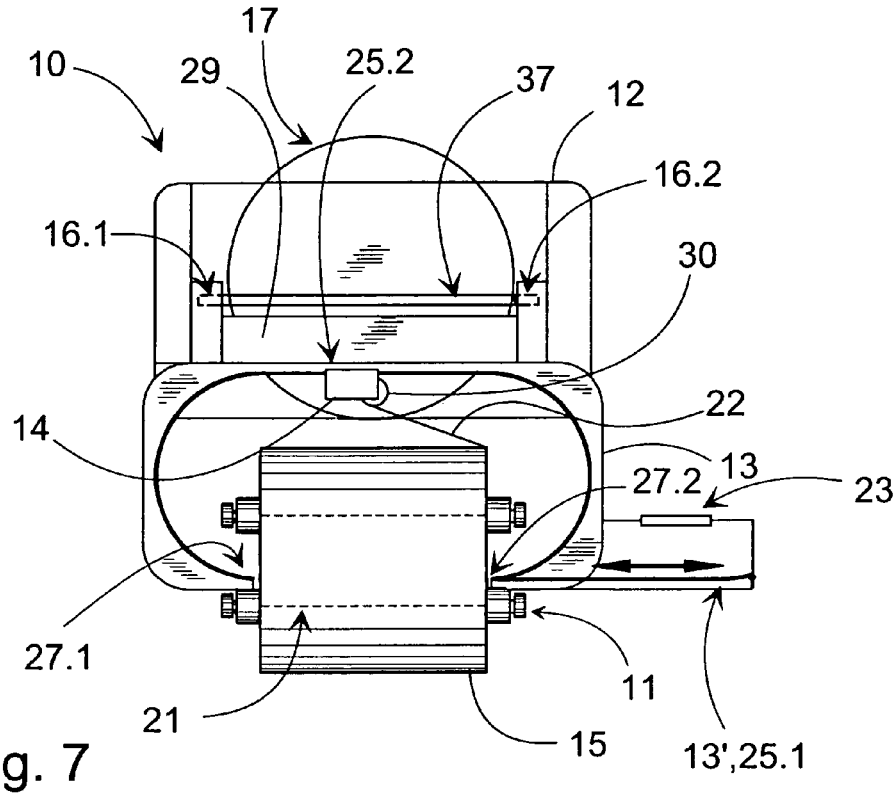
Figure 8:
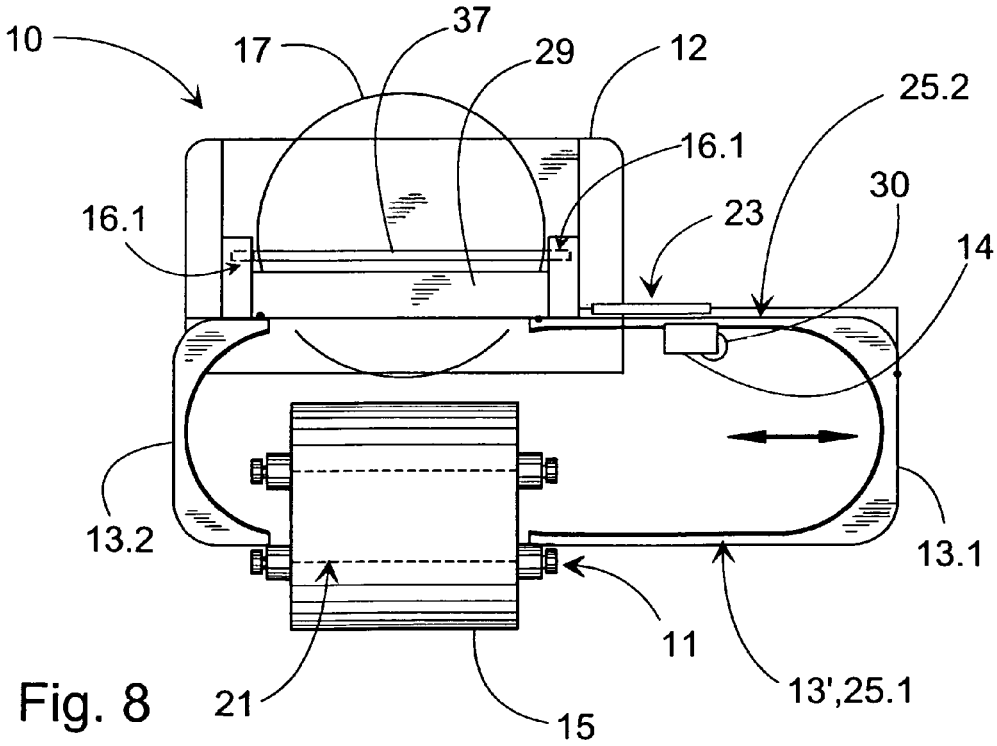

The invention, which is not restricted to the embodiments described in the following, is examined in greater detail with reference to the accompanying drawings, in which FIG. 1 shows a top view of the wrapping device, with the wrapping ring closed, FIG. 2 shows a top view of the wrapping device, with the wrapping ring open, FIG. 3 shows a front view of the wrapping device, with the wrapping ring open, FIG. 4 shows a side view of the wrapping device, illustrating the movement of the wrapping ring around its pivot point, FIG. 5 shows a perspective view of the wrapping device of FIGS. 1-4, FIG. 6 shows a perspective view of the arrangement according to the invention, when applying the wrapping device according to FIGS. 1-4, FIG. 7 shows a top view of a second example of an application for opening the wrapping ring, and FIG. 8 shows a top view of a third example of an application for opening the wrapping ring.

FIGS. 1 and 2 show top views of a first embodiment of the wrapping device 10. The wrapping device 10 includes three main components. The frame 12 of the wrapping device 10, a wrapping ring 13 arranged to be moved relative to the frame 12, and at least one wrapping head 14 arranged to rotate around the wrapping ring 13. The piece being wrapped using the wrapping device 10 can be, for example, a cylindrical reel 15 of sheet metal. The piece 15 being wrapped has a centre hole 21, through which the closed wrapping ring 13 runs when wrapping the piece 15 according to FIG. 1. The wrapping material 22 can be, for example, a band of plastic or paper, which is intended, for example, to protect the piece 15 during transportation and storage.

Operationally, means 11 can also be arranged in connection with the device 10 to rotate the piece 15 around its longitudinal axis 21 during wrapping. In the case according to the embodiment described, the means consist of a set of rotation rollers 11. In this case, the set of rollers 11 consists of two elongated rollers mounted to rotate on shafts, on top of which the cylindrical piece 15 being wrapped can be rotated around its longitudinal axis while wrapping is performed.

A wrapping ring 13, arranged movably relative to the frame 12, is fitted to the frame 12 of the wrapping device 10. The movement of the wrapping ring 13 relative to the frame 12 can be of many kinds. The wrapping ring 13 is pivoted rotatably to the frame 12 at pivot points 16.1, 16.2. Besides pivoting, other ways of implementing the turning are also possible. In the wrapping position according to FIG. 1, the wrapping ring 13 in the horizontal position is attached to the frame 12 at two or more pivot points 16.1, 16.2, in such a way that it can be turned around its horizontal axis of rotation 37 entirely away from above the rotation rollers 11, in other words from the wrapping position of the wrapping ring 13. The wrapping ring 13 will then be entirely removed from the potential feed and removal routes of the pieces 15 being wrapped. This will pre-vent possible collisions that will damage the device 10 when feeding the pieces 15 to wrapping, or removing them from wrapping. In order to turn the wrapping ring 13 vertically, there is a lifting mechanism 24 (FIG. 4) in the frame 12 around the pivot points 16.1, 16.2.

The wrapping-ring structure 13 pivoted in the manner described also permits the pieces 15 being wrapped to be fed to wrapping and removed from it in the direction of the longitudinal axis of the piece 15. By pivoting the wrapping ring 13 horizontally on top of the frame 12 is the wrapping position, the frame 12 remains surprisingly low, so that the structure can also be implemented to be sufficiently stiff. The support of the wrapping ring 13 from several pivot point 16.1, 16.2 at a distance to each other (thus, in this case from at least two points) significantly reduces the free span of the ring 13 and thus makes the ring structure 13 sturdy. The ring 13 can be directly pivoted to the frame 12 from the long side 25.2 next to the frame 12, or it can be attached to a rotation beam 29, which is pivoted to the frame 12. The long side 25.2 of the ring 13 is able to slide in the rotation beam 29 (for example, in a slide-rail arrangement).

The wrapping ring 13, which is pivoted from one, mainly straight, elongated side 25.2 to the frame 12, acts as a guide for the wrapping head 14, which can be arranged to rotate around it. When wrapping is performed, the wrapping ring 13 is in the wrapping position, when it is on the horizontal plane. In that case, the wrapping ring 13 is arranged to move through the axial centre opening 21 of the piece being wrapped, so that the wrapping material 22 can be wrapped by the wrapping head 14 around the piece, along a path 35 (FIG. 5) running through the centre hole 21. The wrapping head 14 can be equipped with an operating device, with the aid of which the wrapping head 14 moves the wrapping ring 13 along an continuous closed track 39 formed for it, winding the wrapping material 22 around the piece 15 being wrapped. The track 39 can be oval in shape, but it can also be, for example, a rectangle with suitably rounded corners. The shape of the track 39 ensures the tension of the wrapping material 22 over the entire length of the wrapping ring 13.

The wrapping ring 13 can be moved away from inside the centre hole 21 of the piece 15 being wrapped. In that case too, the wrapping ring 13 moves relative to the frame 12. This makes it possible to move the wrapping ring 13 by turning it entirely away from the rotation space 20 reserved for the piece 15 being wrapped, where it is in the wrapping position. Moving takes place by turning the wrapping ring 13 vertically away from the rotation space 20. Raising the wrapping ring 13 by turning it permits the pieces 15 being wrapped to be fed and removed without risk of damage to the wrapping device 10. Thus, the actual wrapping device 10 itself can be moved relative to the pieces being wrapped, in order to take a new piece for wrapping.

The moving of the entire wrapping ring 13 away from the wrapping position can be implemented using several different constructions. The wrapping ring 13 in an openable structure. For moving, the device 10 includes a transfer mechanism 23 that creates a movement in the wrapping ring 13 in the axial direction of the piece 15 being wrapped. By means of it, at least the wrapping ring's 13 part 13', which is in the centre hole 21 of the piece 15 being wrapped, can be moved out of the centre hole 21. The wrapping ring's 13 part 13', which is in the centre hole 21 of the piece 15 being wrapped, can be the long side 25.1 of the wrapping ring 13, which is in the axial direction of the piece 15, which is inside the centre hole 21 during wrapping. The side 25.1 of the wrapping ring 13 is the outermost side of the device 10 and is opposite to the side 25.2 of the wrapping ring 13 pivoted to the frame 12. At least the side 25.1 of the ring 13 can be moved linearly, by a transfer mechanism 23, away from inside the centre hole 21, in the axial direction of the piece 15.

FIGS. 1-3 show a first embodiment for implementing the wrapping ring 13, following the basic principle of the invention. FIG. 1 shows a top view when the wrapping ring 13 is closed, while FIG. 2 shows a top view when the wrapping ring 13 is open, and FIG. 3 shows a front view when the wrapping ring 13 is open. Now the wrapping ring 13 is divided into two parts, 13.1, 13.2 on both of its long sides 25.1, 25.2. At least one of the half rings 13.1, 13.2, and in this case both half rings 13.1, 13.2, can be moved in opposite directions in the horizontal plane, i.e. out from inside the centre hole 21 in the axial direction of the piece 15 being wrapped, when the ring 13 is in the wrapping position. At least one 26.1 of the meeting points 26.1 26.2 of the parts 13.1, 13.2 is inside the centre hole 21, when the ring 13 is closed.

FIG. 4 shows a side view of the wrapping device 10, illustrating the turning movement of the wrapping ring 13 around its pivot points 16.1, 16.2. In FIG. 4, the wrapping ring 13 is shown by broken lines when it is away from the wrapping position, i.e. from the rotation position 20. In this case, the device 10 surprisingly forms a device totality that is open from above. For the pivot points 16.1, 16.2, two shaft flanges 38, from which the ring 13 is pivoted to the frame 12, are mounted in bearings on the upper surface 31 of the frame 12. In the frame 12 of the device 10, there is, in addition, a lifting mechanism 32 33, in order to create a vertical lifting movement in the wrapping ring 13 and thus also in the frame 12, on top of which is the ring 13. The lifting mechanism 32, 33 can affect the height position of each corner of the frame 12 independently of each other. Thus it can be used to seek for a suitable position for the wrapping ring 13 relative to the centre hole 21 of the piece 15.

FIG. 5 shows the wrapping device 10 shown in FIGS. 1-4, in which the open wrapping ring 13 is being either lowered to the horizontal wrapping position, or raised vertically away from the wrapping position to the position for changing the piece 15 being wrapped. Lowering and raising take place by turning the wrapping ring 13 around its side pivoted to the frame 12. FIG. 5 shows very clearly the pivoting of the ring 13 to the frame 12 of the device 10. The ring 13 is well supported on the frame 12, because it is pivoted to the frame 12 from its long side 25.2.

When the set of rotation rollers 11 is in connection with the device 10 in the wrapping position, a rotation and wrapping space 20 is reserved above it for the piece 15 being wrapped. The space must be free enough for the wrapping to be able to be performed without obstacles, relative to both the rotation of the piece 15 and to the movement of the wrapping head 14.

The set of rotation rollers 11 can be, for example, installed permanently in connection with the device 10, or also of a moving type, such as that shown in FIGS. 3 and 4. In that case, the set of rotation rollers 11 can move, for example, in the direction of the longitudinal axis of the piece 15, or also at right angles to the longitudinal axis of the piece 15. A moving set of rotation rollers 11 can be used, for example, to move the piece 15 to the wrapping device 10 and to remove it from the wrapping device 10. No separate conveyor track, along which the piece 15 to be wrapped would be brought and removed, need be arranged in connection with the device 10. This simplifies the implementation and reduces the investment costs of the wrapping arrangement. FIGS. 3 and 4 also show the base 11', equipped with wheels, of the set of rotation rollers 11, which is not shown at all in FIGS. 1 and 2 for reasons of clarity. In this case, the device 10 is also equipped with wheels 28, but it can also be installed in a fixed manner.

FIG. 6 shows a perspective view of one example of a system 34 applying a wrapping device according to FIGS. 1-4. The system can be, for example, in connection with a steel mill, in which steel made into a sheet form is manufactured and reeled into compact cylinders with a centre hole, and which is then packed using the device 10 according to the invention. Such a system 34 for wrapping pieces 15 with a centre hole includes a wrapping device 10, a possible changing apparatus 17 for changing the wrapping-material cartridges 30, and means 11 for rotating the pieces 15.1-15.3 around their central axes 21. The means for rotating the pieces 15.1-15.3 around their central axes 21 now consist of a group of rotating devices 11.1-11.5. The wrapping device 10 and the group of rotating devices 11.1-11.5 are, in addition, arranged to be movable relative to each other using the rotation devices 11.1-11.5 in order to use a single wrapping device 10 to wrap the pieces 15.1-15.3 being rotated.

The relative movement of the wrapping device 10 and the rotation devices 11.1-11.5 can be arranged in very many different ways. According to one embodiment, the wrapping device 10 can be equipped with a transfer device 28 (FIG. 4), in order to move it from one rotation device to another. Besides, or instead of the wrapping device 10, the rotation device 11.1-11.5 too, or at least some of them can be equipped with transfer means 35 (FIGS. 3 and 4), for bringing the piece 15 being wrapped into connection with the wrapping device 10 and for moving away from connection with the wrapping device 10. FIG. 6 shows precisely such an embodiment. According to one embodiment, the transfer means 35 are arranged to move the rotation device 11 freely in the desired direction. Thus the rotation device 11 can operate, for example, as an automatically guided trolley. In the embodiment according to FIG. 6, there are rails 40 on the floor of the wrapping hall, along which the rotation devices 11.1-11.5 move linearly in a single line. The steel coils 15' awaiting packaging are moved using onto and away from the rotation devices 11.1-11.5 using, for example, a portal crane 36.

FIG. 7 shows a rough schematic drawing of a second embodiment for removing the ring structure 13 from inside the centre hole 21. This now takes place using a kind of bayonet structure 13'. The bayonet 13' connects the open ends 27.1, 27.2 of the wrapping ring through the centre hole 21 of the piece 15 being wrapped. It should be noted, that in the embodiment in this case too the bayonet component 13', which is inside the centre hole 21 of the piece 15 being wrapped, forms one of the long sides 25.1 of the wrapping ring 13, which can again be moved using a transfer mechanism 21 linearly, in the axial direction of the piece 15 being wrapped, out from inside the centre hole 21 and into the centre hole 21. The bayonet component 13' can be a telescopic, or elongated structure as shown in FIG. 7, extending outside the ring 13 when it opens.

FIG. 8 shows a third embodiment of the ring structure 13 when the ring 13 is open. In this case too, the wrapping ring 13 is divided into two parts 13.1, 13.2 on both of its long sides 25.1, 25.2. At least one of the parts 13.1, 13.2 and now only the second part 13.2 can be moved by the transfer mechanism 23 out from inside the centre hole 21, in the axial direction of the piece 15.

In FIG. 8, the wrapping head 13 is divided into two parts 13.1, 13.2 on its long sides 25.1, 25.2, in such a way that, when the wrapping ring 13 is closed, both meeting points 26.1, 26.2 of the ring halves 13.1, 13.2 are outside the centre hole 21. Thus the meeting points 26.1, 26.2 are on the side of the half 13.2 that does not move. When it is wished to raise the ring 13 to the position for changing the piece 15 being wrapped, the ring half 13.2 of the side 25.1 inside the centre hole 21 is moved axially to the right, when the side 25.1 in question will move entirely out of the centre 21. Finally both ring halves 13.1, 13.2 are turned vertically relative to the pivot point 16.1, 16.2, so that they rise to point upwards at a slant and thus leave the wrapping position.

Besides the device 10, the invention also relates to a method for operating a wrapping device 10. The device 10 can be implemented with several different ways of operation. The basic operation of the device 10 can be, for example, as follows. The wrapping ring 13 can be initially opened, as shown in FIGS. 2 and 3 and turned away from the wrapping space 20, for the feeding of the pieces being wrapped (the wrapping ring 13 in broken lines in FIG. 4). The piece 15 being wrapped can then be brought onto the rotation rollers 11 freely from the chosen direction.

Once the piece 15 has been brought to the rotation space 20 and is on top of the rotation rollers 11 next to the device 10, the open wrapping ring 13 is lowered to the wrapping position (the wrapping ring 13 in solid lines in FIG. 4 and the arrangement according to FIG. 2). The lifting-movement mechanism 32, 33 in the frame part 12 of the device 10 is used to align the wrapping ring 13 with the level of the centre hole 21 of the piece 15 being wrapped. After alignment, the wrapping ring 13 can be closed, when the ring halves 13.1, 13.2 move towards each other. As a result of closing, the wrapping ring 13 forms a closed track 39 for the wrapping head 14 (the arrangement according to FIG. 1).

The end of the wrapping material 22 is pressed against the piece 15 being wrapped, or else the operator of the device 10 attaches the end manually to the piece 15 being wrapped. The wrapping device 10 starts automatically, or else is started by the operator. The wrapping head 14 starts to rotate, at the same time wrapping the wrapping material 22 from at least one reel 30 along the track 39 formed by the wrapping ring 13 in the horizontal wrapping position and running through the centre hole 21 of the piece 15. Simultaneously the set of rotation rollers 11 rotates the piece 15 being wrapped around its central axis in synchronization with the speed of the wrapping head 14.

Once the entire piece 15 has been wrapped, the wrapping is stopped by cutting the wrapping material 22 and attaching the end of the wrapping material 22 to the piece 15 being wrapped. The attaching and cutting can take place automatically, or by the action of the operator.

The wrapping ring 13 is removed from the wrapping space 20 reserved for the piece 15 being wrapped in the opposite order to that of the operations performed before starting wrapping. The wrapping ring 13 that is closed in FIG. 1 is opened by moving the halves 13.1, 13.2 of the wrapping ring 13 in opposite directions out from inside the centre hole 21 of the piece 15 being wrapped, as a result of which the wrapping ring 13 reaches the open position shown in FIG. 2. The wrapping ring 13, which has been opened, i.e. removed from inside the centre hole 21 of the piece 15, is moved entirely away from the wrapping position by raising it vertically to remove the wrapped piece 15 and feed a new piece. Alternatively, the wrapping device 10 can also be used together with a conveyor device, or a set of movable rotation rollers 11 and/or the wrapping device 10 itself can be movable, so that several different alternative ways of moving can be implemented in connection with the changing of the piece in the wrapping device 10.

The wrapped piece 15 can be removed in the chosen direction and a new piece brought to the wrapping space 20. The wrapping ring 13 can be closed again by bringing into the centre hole 21 and beginning wrapping as described above.

FIGS. 4-7 show an embodiment, in which there is also a wrapping-film reel changing device 17, which can also be integrated in the wrapping device 10 according to the invention. The operation of the wrapping-reel 30 changing apparatus 17 in connection with the device 10 is particularly smooth. Using the changing apparatus 17, a wrapping-material cartridge 30, for example, a wrapping-material reel 30 can be changed at the wrapping head 14 of the wrapping device 10. The horizontal wrapping-ring structure 13 in the wrapping position permits, for example, the integration of an automatic wrapping-monitor device 17 on top of the frame structure 12 arranged to move vertically.

The upper part 31 of the frame 12, which remains low, forms a table-like structure, which acts in a surprising manner as a base for the magazine of the changing apparatus 17. The low frame structure 12 also permits the maintenance points of the wrapping device 10 to be placed in such a way that they are easily accessible without special service platforms and stairs. The frame structure 12 permits the changing apparatus 17 to follow the movement of the wrapping ring 13 in the height direction, in such a way that they are always at the same level. There is therefore no need for a separate lifting apparatus to arrange the position of the changing apparatus 17 in the height direction to suit the wrapping ring 13.

Due to the manner of arranging the changing apparatus 17, there is no need to move the wrapping ring 13 specially to the level of the changing apparatus 17, nor to open it in order to perform the wrapping-material reel 30 change. Advantages are then gain in the effective capacity and construction costs of the wrapping device 10. The reel-changing mechanism of the changing apparatus 17 can be implemented, for example, by applying some robot technology that is, as such, known.

It must be understood that the above description and the related figures are only intended to illustrate the present invention. The invention is thus in no way restricted to only the embodiments disclosed or stated in the Claims, but many different variations and adaptations of the invention, which are possible within the scope on the inventive idea defined in the accompanying Claims, will be obvious to one versed in the art.

The invention claimed is:

1. Wrapping device for wrapping a piece to be wrapped, wherein the piece has a through centre hole having a central axis, said wrapping device comprising:

a frame having a table-like structure;

a wrapping ring;

said wrapping ring configured to move horizontally through the center hole in a wrapping position to wrap the piece and away from inside the center hole of the piece in changing position to change the wrapped piece; said wrapping ring also pivotally mounted with one side to the frame on a upper surface of the table-like structure, wherein the pivot point having horizontal axis of rotation to perform the turning movement around the horizontal axis of rotation for moving the wrapping ring entirely away from the horizontal wrapping position; and a wrapping head arranged to rotate around the wrapping ring, in order to wrap the wrapping material around the piece.

2. Wrapping device according to claim 1, characterized in that the device includes a transfer mechanism creating a movement in the axial direction of the piece being wrapped, by means of which at least the part of the wrapping ring inside the centre hole of the piece being wrapped is arranged to be moved away from inside the centre hole and a turning mechanism, by means of which the wrapping ring fitted to the frame is arranged to be turned in the vertical direction away from the horizontal wrapping position.

3. Wrapping device according to claim 2, characterized in that the said part is the elongated side of the wrapping ring, which is, during wrapping, inside the centre hole and the said side is arranged to be moved by the transfer mechanism linearly away from inside the centre hole in the axial direction of the piece being wrapped.

4. Wrapping device according to claim 2, characterized in that the wrapping ring is divided on both of its long sides into two parts, of which parts at least one is arranged to be moved by the transfer mechanism out from inside the centre hole in the axial direction of the piece being wrapped.

5. Wrapping device according to claim 4, characterized in that at least one of the meeting points of the parts is, in the horizontal wrapping position, inside the centre hole and both of the parts are arranged to be moved by the transfer mechanism out from inside the centre hole in the axial direction of the piece being wrapped.

6. Wrapping device according to claim 1, characterized in that the side from which the wrapping ring is fitted to the frame is the elongated side of the wrapping ring, which in the horizontal wrapping position is the opposite side to the side inside the centre hole of the piece being wrapped.

7. Wrapping device according to claim 1, characterized in that operating elements are fitted to the frame, in order to align the wrapping ring relative to the centre hole of the piece being wrapped, and to alter the vertical position of the wrapping ring.

8. Wrapping device according to claim 1, characterized in that the wrapping device is equipped with transfer means, in order to move it parallel to the floor level.

9. Wrapping device according to claim 1, characterized in that the wrapping device includes a changing apparatus of a wrapping-material cartridge, integrated on top of the frame, which is arranged to follow the movement of the wrapping ring in the height direction.

10. Wrapping device according to any of claim 1, characterized in that the device includes, in addition, means for rotating the piece being wrapped during wrapping, which means includes a set of rotation rollers, by means of which the pieces being wrapped are arranged to be moved.

11. System for wrapping pieces with centre holes having a central axes, which system includes a wrapping device, a changing apparatus for changing the wrapping-material cartridge, and means for rotating the pieces around their central axes, characterized in that:

said wrapping device comprises:

a frame having a table-like structure;

a wrapping ring;

said wrapping ring configured to move horizontally through the center hole in a wrapping position to wrap the piece and away from inside the center hole of the piece in changing position to change the wrapped piece; said wrapping ring also pivotally mounted with one side to the frame on a upper surface of the table-like structure, wherein the pivot point having horizontal axis of rotation to perform the turning movement around the horizontal axis of rotation for moving the wrapping ring entirely away from the horizontal wrapping position; and a wrapping head arranged to rotate around the wrapping ring, in order to wrap the wrapping material around the piece;

the means for rotating the pieces around their central axes consists of a group of rotation devices; and the wrapping device and the group of rotation devices are arranged to be movable relative to each other, in order to wrap the pieces to be rotated by the rotation devices using the said single wrapping device.

12. System according to claim 11, characterized in that the wrapping device is equipped with transfer means, in order to move it from one rotation device to another.

13. System according to claim 11, characterized in that the rotation device is equipped with transfer means, in order to bring the piece being wrapped into connection with the wrapping device and to move it away from connection with the wrapping device, and in which the said transfer means are arranged to move the rotation device freely in the desired direction.

14. Method for operating a wrapping device to wrap a piece having a through centre hole having a central axis, the method comprising steps of:

providing a wrapping ring with wrapping material, said wrapping ring configured to move horizontally through the center hole in a wrapping position to wrap the piece and away from inside the center hole of the piece in changing position to change the wrapped piece; said wrapping ring also pivotally mounted with one side to the frame on a upper surface of the table-like structure, wherein the pivot point having horizontal axis of rotation to perform the turning movement around the horizontal axis of rotation for moving the wrapping ring entirely away from the horizontal wrapping position;

wrapping the piece by moving the wrapping ring horizontally through the center hole and rotating said piece around the central axis and providing the wrapping material using the wrapping ring; and changing the wrapped piece when wrapping is complete by moving the wrapping ring away from inside the center hole of the piece and moving the wrapping ring entirely away from the horizontal wrapping position in the vertical direction by performing the turning movement around the horizontal axis of rotation.

* * * * *